US005558452A

United States Patent [19]

Oka et al.

[11] Patent Number: 5,558,452

[45] Date of Patent: Sep. 24, 1996

[54] HOLDER TUBE FOR WRITING INSTRUMENT

[75] Inventors: Shigeo Oka, Tokyo; Takayuki Hoshi, Funabashi, both of Japan

[73] Assignee: Pentel Kabushiki Kaisha, Japan

[21] Appl. No.: 244,914

[22] PCT Filed: Oct. 14, 1993

[86] PCT No.: PCT/JP93/01475

§ 371 Date: Jun. 28, 1994

§ 102(e) Date: Jun. 28, 1994

[87] PCT Pub. No.: WO94/09996

PCT Pub. Date: May 11, 1994

[30] Foreign Application Priority Data

Oct. 29, 1992 [JP] Japan ..... 4-080980
Jul. 15, 1993 [JP] Japan ..... 5-043690

[51] Int. Cl.[6] ..... B43K 23/00

[52] U.S. Cl. ..... 401/6; 401/8; D19/48

[58] Field of Search ..... 401/6, 88; D19/48, D19/55

[56] References Cited

U.S. PATENT DOCUMENTS 132,174 10/1872 Orton ..... 401/88
1,376,115 4/1921 Record ..... 401/88 X
1,395,793 11/1921 Brosehart ..... 401/88 X
1,577,548 3/1926 Upton ..... 401/88 X
2,173,451 9/1939 Lorber ..... 401/88 X
4,035,089 7/1977 Schwartz et al. ..... 401/6

FOREIGN PATENT DOCUMENTS 674641 4/1939 Germany ..... 401/6
3049467 7/1982 Germany ..... 401/88
57-024522 5/1982 Japan .
62-094076 6/1987 Japan .
62-182781 11/1987 Japan .
63-170278 11/1988 Japan .

*Primary Examiner*—Steven A. Bratlie
*Attorney, Agent, or Firm*—Adams & Wilks

[57] ABSTRACT

A holder tube for a writing instrument in which a plurality of rings having external faces subjected to different treatments are removably disposed in at least a grip portion of the holder tube. In another form of holder tube for a writing instrument, a plurality of rings having non-circular external faces are disposed in at least a grip portion of the holder tube in such a manner that the state of each of the rings differs from that of the adjacent one. In another form of holder tube for a writing instrument, at least three rings having different diameters are removably disposed in at least a grip portion of the holder tube. In a further form of holder tube for writing instrument, a ring or rings having longitudinally different external shapes are removably disposed in at least a grip portion of the holder tube.

31 Claims, 3 Drawing Sheets

HOLDER TUBE FOR WRITING INSTRUMENT

FIELD OF THE INVENTION

The present invention relates to a holder tube for a writing instrument which is arranged to allow a user to select a desired shape for a grip portion according to the preference of the user, that is, a holder tube which is arranged to allow a user to select a desired grip touch according to the preference of the user.

BACKGROUND OF THE INVENTION

To mitigate fatigue due to long-time writing as much as possible, the grip portions of writing instruments have heretofore been designed in various manners. For example, a grip portion of modified shape or increased diameter is known, and the position of a center of balance is ergonomically determined according to the weight of each writing instrument, and a grip portion provided with an anti-slip part are known. As disclosed in Japanese Utility Model Publication No. 57-24522/1982, it is also known that a grip of large diameter and a grip of small diameter are provided so that a user can select a desired grip to be fitted onto a grip portion according to the choice or preference of the user.

However, although a user can change his or her grip position for a writing instrument by gripping the forward end portion, the middle portion or the rearward portion of the writing instrument according to the preference of the user, it is impossible to change a shape of the grip portion of the writing instrument, so that there still remains a problem in that the user feels fatigue after continuous, long-time writing. Further, there is a problem in terms of design since the shape of the conventional grip portion of the writing instrument is fixed and cannot be changed. In the art disclosed in Japanese Utility Model Publication No. 57-24522/1982, although it is possible to provide different grip touches by selecting either one of the grip portions of large diameter and small diameter, the number of selectable grip touches is limited.

SUMMARY OF THE INVENTION

An object of the present invention is to provide a holder tube for a writing instrument which allows a user to select a desired grip touch from among a wide variety of grip touches according to the preference of the user so that fatigue due to long-time writing can be mitigated as much as possible.

This invention has been made to achieve the above object, and a first feature of the invention resides in a holder tube for a writing instrument in which a plurality of rings having external faces subjected to different treatments are removably disposed in at least a grip portion of the holder tube. A second feature of the invention resides in a holder tube for a writing instrument in which a plurality of rings having non-circular external faces are disposed in at least a grip portion of the holder tube in such a manner that the state of each of the rings differs from that of the adjacent one. A third feature of the invention resides in a holder tube for a writing instrument in which not less than three rings having different diameters are removably disposed in at least a grip portion of the holder tube. A fourth feature of the invention resides in a holder tube for a writing instrument in which a ring or rings having longitudinally different external shapes are removably disposed in at least a grip portion of the holder tube. A fifth feature of the invention resides in the holder tube in which the rings according to the fourth feature are a plurality of kinds of rings.

In accordance with any of the aforesaid constructions, it is possible for each individual user to change its grip portion so that a desired grip touch can be obtained according to the taste or preference of the user. It is also possible to provide a holder tube for a writing instrument having an additional advantage which can widen the range of variations of the design of the holder tube.

DETAILED DESCRIPTION OF THE INVENTION

Preferred embodiments of this invention will be described with reference to the accompanying drawings.

Figure 1:
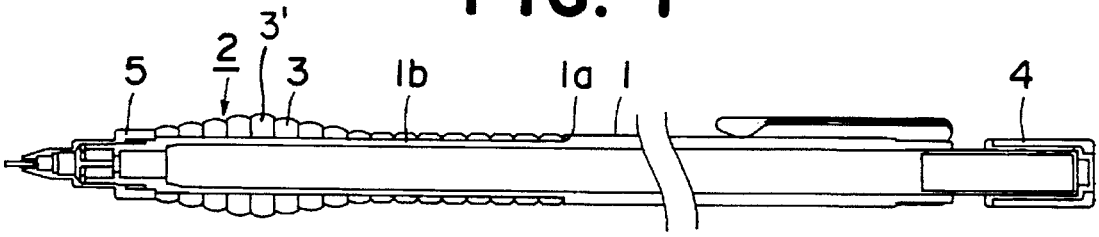
FIG. 1 is a partially omitted, longitudinally sectional view of a writing instrument showing an embodiment of the present invention.

FIG. 1 shows an embodiment of the present invention which is applied to a mechanical pencil. The embodiment has a well-known construction, except for the construction of a grip portion 2 which constitutes a forward portion of a holder tube or barrel 1 of a writing instrument. In the well-known construction, a lead supplying mechanism (not shown) is disposed within the holder tube 1, while a lead accommodating pipe (not shown) which is followed by a knock member 4 is disposed in a rearward portion of the holder tube or barrel 1. A tip member 5 is disposed at the forward end of the holder tube 1. As a matter of course, the present invention can be applied to not only a mechanical pencil but also various writing instruments, such as a ball-point pen, a fountain pen and marking pen.

In the grip portion 2, a plurality of (in the embodiment of FIG. 1, seventeen) rings 3 are secured between a step 1a formed around the holder tube I and the tip member 5, and are consecutively arranged to surround a small-diameter portion 1*b* of the holder tube 1. The material of the rings 3 is selected from among thermoplastic elastomer, silicone rubber, vinyl chloride, urethane, styrene foam, brass, phosphor bronze, wood and the like. The material of the rings 3 may also be selected from among materials having anti-slip properties, such as thermoplastic elastomer, silicone resin and wood, or materials having no anti-slip properties. It is also possible to use various other materials, such as materials having a pattern, such as a knurling or a grid, formed by a chemical treatment, a mechanical treatment, a physical treatment or the like, materials having a multiplicity of small projections, materials covered with cloth, materials having a surface treated with a substance having anti-slip properties, such as thermoplastic elastomer or silicone resin, and materials having anti-slip properties imparted by coating. Incidentally, the rings 3 may be uncolored or colored. If colored, the rings 3 may have different colors.

As shown in FIG. 1, some of the rings 3 have different outer diameters to jointly define a grip at a front portion of the holder tube or barrel 1. One ring 3' has a larger diameter than the others and defines the maximum diameter portion of the grip, and the grip tapers inwardly from the maximum diameter portion in both the frontward and rearward axial directions of the writing instrument barrel.

Means for securing the rings 3 may be other than the shown type. For example, the rings 3 may be simply fitted onto the small-diameter portion 1*b* of the holder tube 1, or recesses or projections may be formed in or on the external face of the small-diameter portion 1*b* of the holder tube 1, while projections or recesses may be formed in or on the internal face of each of the rings 3, and the rings 3 may be secured to the small-diameter portion 1*b* by fitting the recesses or projections of the rings 3 into or onto the recesses or projections of the small-diameter portion lb. Threaded portions may be formed around the external face of the small-diameter portion 1*b* and around the internal face of the rings 3, and the rings 3 may be screwed onto the small-diameter portion 1*b*.

The small-diameter portion 1*b* formed by the step 1*a* of the holder tube 1 is not an essential requirement, and the rings 3 may, of course, be disposed on a holder tube having no step.

Figure 3:
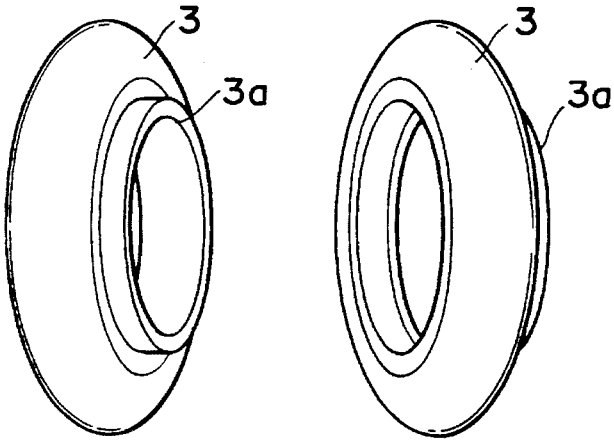
FIG. 3 is a perspective view of a ring according to another example.

In the embodiment shown in FIG. 1, the rings 3 are secured between the step la and the tip member 5, and are disposed in such a manner that each of the rings 3 abuts in end-to-end relation with the others. As shown in FIG. 3, connecting means 3*a* is provided on each of the rings 3. If the connecting means 3*a* is provided on each of the rings 3, the rings 3 may be disposed on the small-diameter portion 1*b* of the holder tube 1 after the rings 3*a* are connected in a desired form. A gap may be provided between the adjacent rings 3 with or without providing connecting means as the connecting means 3*a* on the rings 3.

The rings 3 will be described below in further detail.

Figure 2:
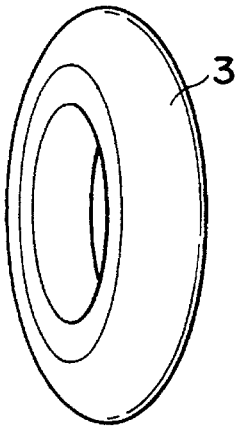
FIG. 2 is a perspective view of a ring according to an example.

The shape of the external face of each of the rings 3 need not necessarily be circular as shown in FIG. 1 or 2, and it is also possible to adopt various non-circle shapes such as ellipse, star-like shape, triangle, rectangle, hexagon and octagon. Also, circular rings and non-circular rings may be combined, or rings having different non-circular shapes may be combined. The cross-sectional shape of each of the rings 3 may be solid or hollow. One interesting example is to prepare inflatable rings each having a hollow cross section and made from an expansible member and dispose the rings in such a manner that their external diameters can be varied by varying the amounts of air in their hollow portions.

Figure 4:
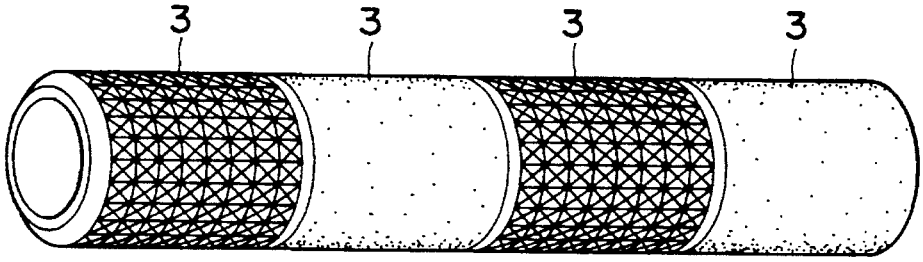
FIG. 4 is a perspective view of a ring according to another example.
Figure 5:
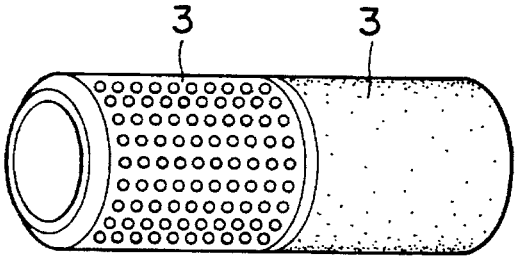
FIG. 5 is a perspective view of a ring according to a further example.
Figure 6:
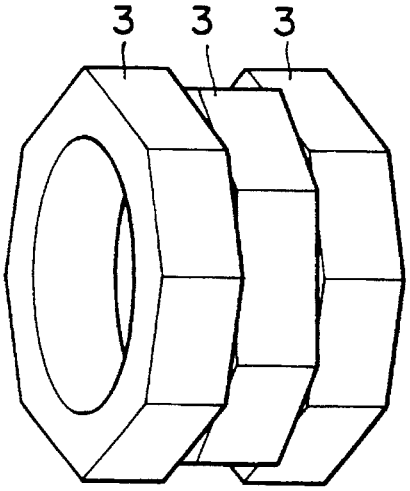
FIG. 6 is a perspective view of rings showing one state in which the rings are combined.
Figure 7:
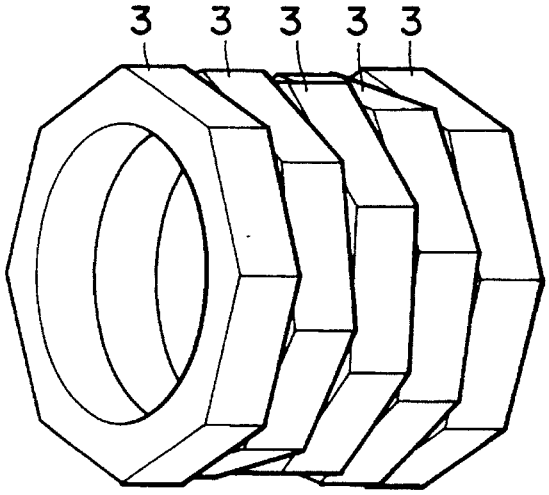
FIG. 7 is a perspective view of the rings showing another state of combination.

If the shapes of the external faces of the rings 3 are circular as shown in FIG. 1, it is preferable that the rings 3 have different sizes. However, if a plurality of rings having external faces subjected to different treatments are prepared, all the rings may be of the same size. For example, as shown in FIG. 4, some of the rings 3 may have grid-like external faces and the other may have pear skin-like (satin finished) external faces, or, as shown in FIG. 5, some of the rings 3 may have pear skin-like (satin finished) external faces and the other may have external faces provided with small projections. If the shapes of the external faces are non-circular, the sizes of the rings 3 may be made different or the same. FIGS. 6 and 7 show examples in which the rings 3 of the same size are used. In the example shown in FIG. 6, the rings 3 are disposed in the state of being alternately offset, or staggered, by a predetermined angle. In the example shown in FIG. 7, the rings 3 are offset from the adjacent one by a predetermined angle in such a manner that the corners of the rings 3 are helically arranged. In other words, the examples shown in FIGS. 6 and 7 are such that a plurality of non-circular rings 3 having the same external faces are disposed in such a manner that the position of each ring 3 differs from the position of the adjacent one.

Figure 8:
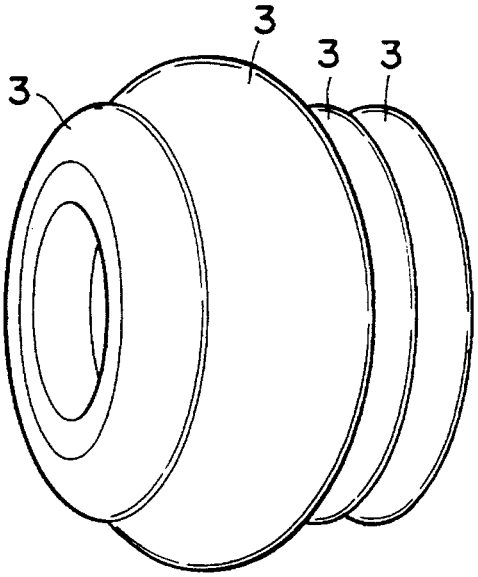
FIG. 8 is a perspective view of rings showing another state in which the rings are combined.

Although the widths of all the rings 3 may be made equal as shown in FIG. 1, all or part of the rings 3 may have different widths. Accordingly, as shown in FIG. 8, one ring 3 of greater width and a plurality of rings 3 of smaller width may be combined. Otherwise, a plurality of rings 3 of greater width and a plurality of rings 3 of smaller width may be arranged in arbitrary combination.

Regarding the number and arrangement of the rings 3, in the embodiment shown in FIG. 1, a multiplicity of rings 3 are employed, and are arranged approximately from the forward portion of the holder tube 1 up to the middle portion thereof. However, the number of the rings 3 needs only to be more than one, and the rings 3 need only to be arranged in at least the grip portion 2 of the holder tube 1. Of course, the rings 3 may also be arranged over the entire length of the holder tube 1.

Figure 9:
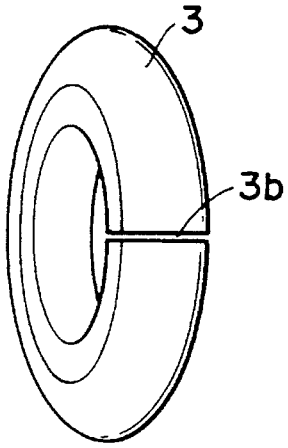
FIG. 9 is a perspective view of a ring in another example.

As shown in FIG. 9, the ring 3 may also have a cut 3*b* so that it can be extended outwardly. Accordingly, in accordance with the above-described embodiment, it is possible to provide a variety of grip touches by changing the arrangement of the rings 3. For example, in the embodiment shown in FIG. 1, the rings 3 may be arranged, though not shown, in such a manner that the rings 3 of larger diameters are disposed in the forward and backward portions, while the rings 3 of smaller diameters are disposed in the middle portion, or that the diameters of the rings 3 become gradually larger or smaller from the backward portion toward the forward portion, or that the rings 3 form various external shapes, such as a wave shape.

Figure 10:
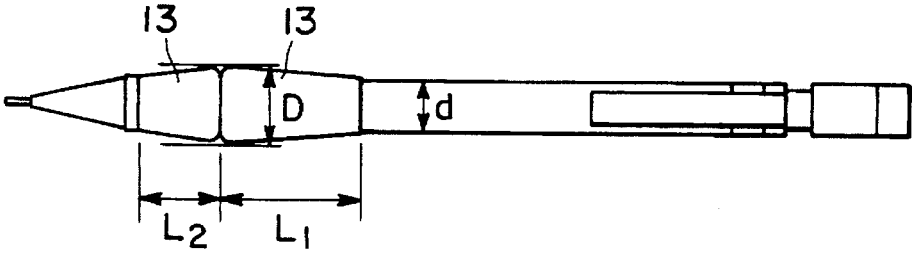
FIG. 10 is a plan view of a writing instrument showing another embodiment.

FIGS. 10 and 11 show another embodiment. A primary difference between this embodiment and the previous embodiment resides in the shape of a ring. The embodiment shown in FIGS. 10 and 11 employs two different kinds of tubular members which have different external shapes formed in their axial or longitudinal directions. The other features are similar to those of the previous embodiment.

Specifically, in accordance with the embodiment of FIGS. 10 and 11, the external shape formed by two frusto conical rings 13 can be changed into twelve patterns, inclusive of the six patterns shown in FIGS. 10 and 11, by changing the positions and orientations of the respective two rings 13. As shown in FIGS. 10 and 11, the diameters of the larger ends and the diameters of the smaller ends of the two frusto-conical rings 13 are the same, and the axial length $L_1$ of the longer ring 13 is approximately twice the axial length $L_2$ of the shorter ring 13. Further, as shown in FIG. 10, the larger ends of the two rings 13 have an outer diameter D not more than 50% greater than the diameter d of the writing instrument barrel.

Since the other features of the rings 13, such as material, treatment for external face, color, securing means, shape of external face, width (length) and arrangement position, are basically similar to those described in connection with the previous embodiment, the description of such features is omitted.

Figure 12:
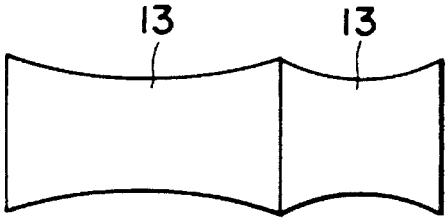
FIG. 12 is a plan view of rings showing another example of the combination.
Figure 11A:
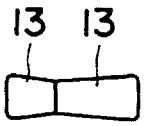
FIGS. 11*a*–11*e* are plan views showing different patterns of the combination of rings.
Figure 11B:
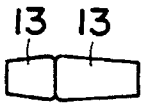
Figure 11C:
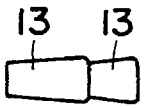
Figure 11D:
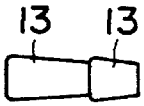
Figure 11E:
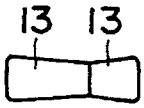
Figure 13:
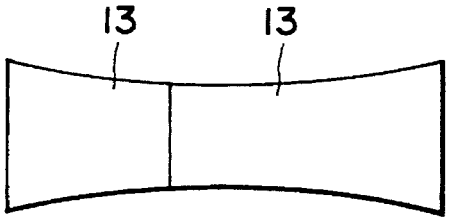
FIG. 13 is a plan view of rings showing another example of the combination.

Similar to the previous embodiment, it is possible in this embodiment to make various modifications. For example, rings 13 having different external shapes, such as those shown in FIGS. 12 and 13, may be combined, or the number of variation patterns may be increased by increasing the number of rings to be combined. One example having an increased number of variation patterns is shown in FIG. 14.

Figure 14:
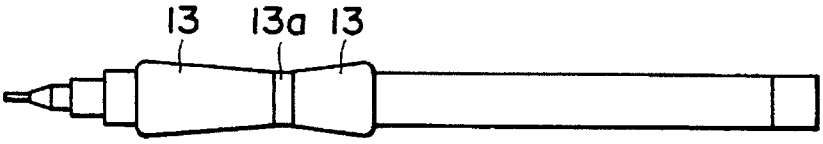
FIG. 14 is a plan view of a writing instrument in another embodiment.

In the example shown in FIG. 14, a cylindrical ring 13*a* having a flat outer shape is employed in addition to the two tubular rings having a frusto-conical shape.

Specifically, in this example, by changing the orientations and the arrangement order of the two tubular rings 13 as well as the arrangement position of the flat ring 13*a*, it is possible to achieve twenty-four pattern variations, inclusive of the five patterns shown in FIGS. 14 and 15. Of course, similarly to the previous embodiments, it is possible to adopt various external shapes for the rings 13.

Figure 16:
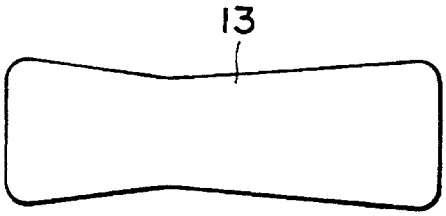
FIG. 16 is a plan view of a ring showing another example.
Figure 15A:
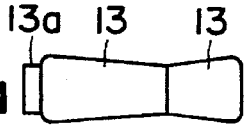
FIGS. 15*a*–15*d* are plan views showing different patterns of the combination of rings.
Figure 15B:
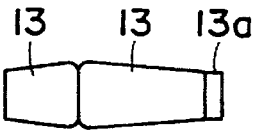
Figure 15C:
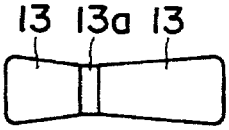
Figure 15D:
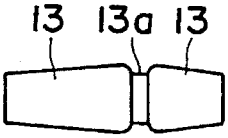
Figure 17:
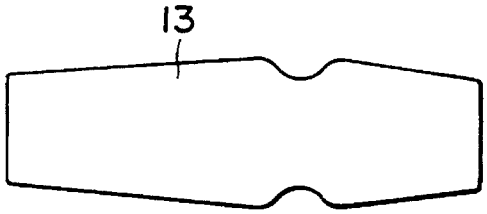
FIG. 17 is a plan view of a ring showing a further example of the ring.

FIGS. 16 and 17 show further embodiments, and a primary difference between these embodiments and each of the previous embodiments of FIGS. 10 and 14 is that one ring 13 is employed rather than combination of rings. In this embodiment, it is possible to increase the number of selectable grip touches by changing a grip position and or the orientation of the ring 13.

What is claimed is:

1. A grip for a writing instrument, comprising: a first frusto-conical ring and a second frusto-conical ring each disposed around and on a barrel of a writing instrument, the first frusto-conical ring having a substantially longer axial length than the second frusto-conical ring, and the first and second frusto-conical rings being in abutting end-to-end contact with each other at a front portion of the writing instrument barrel to define a grip.

2. A grip according to claim 1; wherein the first and second frusto-conical rings each have a progressively varying diameter throughout the axial length thereof.

3. A grip according to claim 2; wherein the first and second frusto-conical rings each have a smaller diameter end and a larger diameter end, the smaller diameter ends of both rings being the same size and the larger diameter ends of both rings being the same size.

4. A grip according to claim 3; wherein the first and second frusto-conical rings are each configured to be removably disposed on the writing instrument barrel in either of two different axial orientations.

5. A grip according to claim 4; wherein substantially the entire axial length of the writing instrument barrel, except for the front portion thereof at which are disposed the first and second frusto-conical rings, is freely exposed and free of any external rings.

6. A grip according to claim 3; wherein the axial length of the first frusto-conical ring is approximately two times greater than the axial length of the second frusto-conical ring.

7. A grip according to claim 3; wherein the larger diameter ends of the first and second frusto-conical rings have a diameter not more than 50% greater than the diameter of the writing instrument barrel.

8. A grip according to claim 7; wherein the first and second frusto-conical rings are each configured to be removably disposed on the writing instrument barrel in either of two different axial orientations.

9. A grip according to claim 1; wherein the first and second frusto-conical rings each have a smaller diameter end and a larger diameter end, the smaller diameter ends of both rings being the same size and the larger diameter ends of both rings being the same size.

10. A grip according to claim 1; wherein substantially the entire axial length of the writing instrument barrel, except for the front portion thereof at which are disposed the first and second frusto-conical rings, is freely exposed and free of any external rings.

11. A grip for a writing instrument, comprising: a plurality of rings each disposed around and on a barrel of a writing instrument, the rings being in abutting end-to-end contact with one another at a front portion of the writing instrument barrel, at least some of the rings having different outer diameters to jointly define a grip which has a maximum diameter portion and which tapers inwardly from the maximum diameter portion in both the frontward and rearward axial directions of the writing instrument barrel.

12. A grip according to claim 11; wherein the grip is comprised of at least five rings.

13. A grip according to claim 12; wherein the maximum diameter portion of the grip is defined by one ring which has a greater outer diameter than any of the other rings.

14. A grip according to claim 13; wherein all the rings of the grip have the same thickness in the axial direction of the writing instrument barrel.

15. A grip according to claim 11; wherein the rings of the grip comprise inflatable rings which are inflated with air.

16. A grip according to claim 11; wherein the maximum diameter portion of the grip is defined by one ring which has a greater outer diameter than any of the other rings.

17. A grip according to claim 11; wherein all the rings of the grip have the same thickness in the axial direction of the writing instrument barrel.

18. A grip according to claim 11; wherein the rings of the grip have a circular shape.

19. A grip according to claim 11; wherein the rings of the grip have a non-circular shape.

20. A grip according to claim 11; wherein the barrel of the writing instrument has a reduced diameter portion on which the rings are disposed.

21. A grip for a writing instrument, comprising: a first frusto-conical ring, a second frusto-conical ring and a third non-frusto-conical ring each disposed around and on a barrel of a writing instrument, the first frusto-conical ring having a substantially longer axial length than the second frusto-conical ring, the second frusto-conical ring having a substantially longer axial length than the third non-frusto-conical ring, and the first, second and third rings being in abutting end-to-end contact with each other at a front portion of the writing instrument barrel to define a grip.

22. A grip according to claim 21; wherein the first and second frusto-conical rings each have a progressively varying diameter throughout the axial length thereof.

23. A grip according to claim 22; wherein the first and second frusto-conical rings each have a smaller diameter end and a larger diameter end, the smaller diameter ends of both rings being the same size and the larger diameter ends of both rings being the same size.

24. A grip according to claim 23; wherein the first and second frusto-conical rings are each configured to be removably disposed on the writing instrument barrel in either of two different axial orientations and in any desired axial arrangement relative to the third non-frusto-conical ring.

25. A grip according to claim 24; wherein substantially the entire axial length of the writing instrument barrel, except for the front portion thereof at which are disposed the first, second and third rings, is freely exposed and free of any external rings.

26. A grip according to claim 23; wherein the axial length of the first frusto-conical ring is approximately two times greater than the axial length of the second frusto-conical ring.

27. A grip according to claim 23; wherein the larger diameter ends of the first and second frusto-conical rings have a diameter not more than 50% greater than the diameter of the writing instrument barrel.

28. A grip according to claim 21 wherein the first and second frusto-conical rings are each configured to be removably disposed on the writing instrument barrel in either of two different axial orientations and in any desired axial arrangement relative to the third non-frusto-conical ring.

29. A grip according to claim 21; wherein the first and second frusto-conical rings each have a smaller diameter end and a larger diameter end, the smaller diameter ends of both rings being the same size and the larger diameter ends of both rings being the same size.

30. A grip according to claim 21; wherein substantially the entire axial length of the writing instrument barrel, except for the front portion thereof at which are disposed the first, second and third rings, is freely exposed and free of any external rings.

31. A grip according to claim 21; wherein the third ring has a cylindrical shape.

* * * * *